US007218883B2

(12) United States Patent
Aruga et al.

(10) Patent No.: US 7,218,883 B2
(45) Date of Patent: May 15, 2007

(54) IMAGE FORMING APPARATUS

(75) Inventors: Tomoe Aruga, Nagano-Ken (JP); Nobumasa Abe, Nagano-Ken (JP); Yujiro Nomura, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 826 days.

(21) Appl. No.: 10/304,050

(22) Filed: Nov. 26, 2002

(65) Prior Publication Data

US 2003/0142373 A1 Jul. 31, 2003

(30) Foreign Application Priority Data

Nov. 27, 2001 (JP) ..... 2001-360951
Nov. 27, 2001 (JP) ..... 2001-360954
Jan. 28, 2002 (JP) ..... 2002-017878

(51) Int. Cl.
*G03G 15/01* (2006.01)

(52) U.S. Cl. ..... 399/302

(58) Field of Classification Search ..... None
See application file for complete search history.

(56) References Cited

U.S. PATENT DOCUMENTS 6,223,008 B1 * 4/2001 Takahashi et al. ..... 399/66

FOREIGN PATENT DOCUMENTS

| | | | |
|---|---|---|---|
| EP | 1113341 A1 | * | 7/2001 |
| JP | 08-305115 | | 11/1996 |
| JP | 10-020608 | | 1/1998 |
| JP | 10-239940 | | 9/1998 |
| JP | 11-095520 | | 4/1999 |
| JP | 11-242173 | | 9/1999 |
| JP | 2000-231277 | | 2/2000 |
| JP | 2000-181184 | | 6/2000 |
| JP | 2001117460 A | * | 4/2001 |
| JP | 2001-134108 | | 5/2001 |
| JP | 2001305872 A | * | 11/2001 |
| JP | 2002162806 A | * | 6/2002 |

* cited by examiner

*Primary Examiner*—Quana Grainger
(74) *Attorney, Agent, or Firm*—Sughrue Mion, PLLC

(57) ABSTRACT

An image forming apparatus comprises: an image transfer carrying means 18 having flexibility and having an endless sleeve-like shape; a plurality of image forming means 7 which are arranged along the image transfer carrying means 18 such that respective image carriers 17 thereof are in contact with the image transfer carrying means 18, each image forming means 7 comprising a latent image forming means 6 for forming a latent image on the image carrier and a developing means for developing the latent image formed on the image carrier; and transfer bias applying means 16 which are disposed on the back of the image transfer carrying means at positions where the respective image carriers are in contact with the image transfer carrying means for applying transfer bias. The image transfer carrying means 18 is laid around at least two rollers with certain tension and is positioned to be in contact with the image carriers 17 to have predetermined nip width therebetween and each transfer bias applying means abuts the image transfer carrying means 18 to have a contact area narrower than the nip width for applying transfer bias. At gradually increasing spaces at the entrance end and the exit end of each nip portion of the image transfer carrying means, even with high transfer bias voltage, the discharge phenomenon and an undesired phenomenon of toner image scattering from predetermined positions are prevented, thus preventing the deterioration of image quality.

1 Claim, 10 Drawing Sheets

IMAGE FORMING APPARATUS

BACKGROUND OF THE INVENTION

The present invention relates to an image forming apparatus including an image transfer carrying means having an endless sleeve-like shape and having flexibility, a plurality of image forming means which are arranged along the image transfer carrying means such that respective image carriers thereof are in contact with the image transfer carrying means, each image forming means comprising a latent image forming means for forming a latent image on the image carrier and a developing means for developing the latent image formed on the image carrier, and transfer bias applying means which are disposed on the back of the image transfer carrying means at positions where the respective image carriers are in contact with the image transfer carrying means for applying transfer bias, whereby toner images developed by the image forming means are sequentially transferred to the image transfer carrying means such that the toner images are superposed on each other.

Tandem-type image forming apparatuses are categorized into two types as:

an apparatus employing a paper delivery method which comprises a plurality of image forming stations arranged in an array, in which a receiving medium is electrostatically attracted to a delivery belt and is fed to be brought in contact with the respective stations in order and electrostatic transferring force is applied between each station and the receiving medium, thereby superposing toner images of plural colors while directly transferring the toner images to the receiving medium; and an apparatus employing an intermediate transfer method which comprises a plurality of image forming stations arranged in an array, in which an intermediate transfer belt made of a dielectric substance is fed to be brought in contact with the respective stations and electrostatic transferring force is applied between each station and the intermediate transfer belt so as to transfer primarily toner images of the respective stations one by one to superpose the toner images on the intermediate transfer belt and the superposed toner images are transferred secondarily from the intermediate transfer belt to a receiving medium at once.

In the aforementioned paper delivery method, it is required to provide a means (roller or brush) for attracting the receiving medium to the delivery belt and high voltage power supply. In the intermediate transfer method, however, such a means and high voltage power supply are not required. Further, in the paper delivery method, it is required to strictly control the transfer bias to be applied to respective image transfer portions according to the size, the thickness, and the kind of the receiving medium. In the intermediate transfer method, the primary transfer of toner images is conducted to the intermediate transfer belt of which resistance, thickness, and surface roughness are constant regardless of the aforementioned factors of the receiving medium. The control of the transfer condition including the transfer voltage or transfer current and contact pressure must be conducted only for the secondary transfer of the toner images to the receiving medium. Therefore, the intermediate transfer method has a lot of advantages.

On the other hand, the apparatus can also be categorized according to the arrangement of the respective image forming stations. There are a method of arranging the stations horizontally and a method of arranging the stations vertically. The former has a disadvantage of requiring a larger area for placing, while the latter has a disadvantage of making the apparatus too tall to be put on a desk.

Therefore, a method of arranging the respective image forming stations obliquely is conventionally known as disclosed in Japanese Patent Unexamined Publication No. H11-95520 and Japanese Patent Unexamined Publication No. H8-305115. The former has exposure devices corresponding to the image forming stations, respectively, and the latter has an exposure device common to the respective image forming stations.

In an image forming apparatus employing an image transfer carrying means composed of a carrying belt or an intermediate transfer belt which is in contact with a plurality of image carriers to sequentially receive toner images from the image carriers to form a multiple-color image thereon and carries the multiple-color image, however, there are frequently differences between the condition of transferring a first toner image from the first image carrier and the condition of transferring a second toner image from the second image carrier onto the first toner image, . . . and the condition of transferring a n-th toner image from the n-th image carrier onto the n-1-th toner image. The condition may be changed because the condition is affected by attributes of the toner image(s) previously transferred. In particular, the contact pressure and contact form between each image carrier and the image transfer carrying means, the form of applying transfer bias for transferring each toner image and the like are important requirements for determining the condition for sequentially transferring the toner images by contacts of the plurality of image carriers such that the toner images are superposed on each other.

FIG. 1 is an illustration for explaining the phenomenon of image deterioration due to the transfer bias at a nip. Typically, a conductive roller 16 made of an elastic material such as rubber is pressed against an image transfer carrying means 18 with a contact pressure *f* as shown in FIG. 1 so as to form a nip between an image transfer carrying means and an image carrier carrying a toner image formed thereon. Therefore, the transfer nip is formed between the image transfer carrying means 18 and the image carrier 17 and a transfer bias is applied to the nip, thereby transferring the toner image T from the image carrier 17 to the image transfer carrying means 18. During this, the transfer current flowing from the elastic conductive roller 16 through the image transfer carrying means 18 is substantially constant over the entire area of the nip because the lengths of current paths from the contact between the elastic conductive roller 16 and the image transfer carrying means 18 to the image carrier 17 are all constant.

However, since there are gradually increasing spaces at the entrance end and the exit end of the nip of the image transfer carrying means 18, the discharge phenomenon occurs at the spaces with higher voltage of the transfer bias applied from the conductive roller 16, causing undesirable phenomena such as toner T scattering from predetermined positions and thus leading to image deterioration.

SUMMARY OF THE INVENTION

An object of the present invention is to prevent image deterioration by preventing the discharge phenomenon and an undesired phenomenon of toner image scattering from predetermined positions at the entrance end and the exit end of a nip. Another object of the present invention is to provide an image forming apparatus capable of forming high-quality images in which the transfer condition can be stabilized by an inexpensive structure without a special means of applying contact pressure, thereby preventing deterioration of image quality.

For achieving the aforementioned object, the present invention provides an image forming apparatus comprising: an image transfer carrying means having flexibility and having an endless sleeve-like shape; a plurality of image forming means which are arranged along the image transfer carrying means such that respective image carriers thereof are in contact with the image transfer carrying means, each image forming means comprising a latent image forming means for forming a latent image on the image carrier and a developing means for developing the latent image formed on the image carrier; and transfer bias applying means which are disposed on the back of the image transfer carrying means at positions where the respective image carriers are in contact with the image transfer carrying means for applying transfer bias, the image forming apparatus being characterized that the image transfer carrying means is laid around at least two rollers with certain tension and is positioned to be in contact with the image carriers to have predetermined nip width therebetween and the transfer bias applying means each abut the image transfer carrying means to have a contact area narrower than the nip width for applying transfer bias.

The image forming apparatus of the present invention is characterized in that said image transfer carrying means and the image carriers are arranged in such a positional relation that said image transfer carrying means is disposed in contact with said image carriers from above and that said image transfer carrying means is disposed to have predetermined wrapping angles relative to the respective image carriers of the image forming means, and further characterized in that said image transfer carrying means has a conductive layer at least on its surface to be in contact with the image carriers so that the energization is achieved through the conductive layer or that said image transfer carrying means is formed of a conductive member so as to achieve the energization.

Further, the present invention provides an image forming apparatus comprising: an image transfer carrying means having flexibility and having an endless sleeve-like shape; and a plurality of image forming means which are arranged along the image transfer carrying means such that respective image carriers thereof are in contact with the image transfer carrying means, each image forming means comprising a latent image forming means for forming a latent image on the image carrier and a developing means for developing the latent image formed on the image carrier, the image forming apparatus being in characterized in that a contact pressure is defined and applied by the wrapping angle of the image transfer carrying means relative to the image carrier of each image forming means and by the tension of the image transfer carrying means so that the developed toner images of the respective image forming means are transferred and superposed on the image transfer carrying means one by one.

The image forming apparatus of the present invention is characterized in that the wrapping angles of said image transfer carrying means relative to the respective image carriers can be set to be substantially equal to each other, that the image carriers of said image forming means and said image transfer carrying means are set to have velocity difference therebetween, and that the image transfer carrying means is laid around at least two rollers, and the position of the driving roller is selected to the upstream side or the downstream side according to the velocity difference relative to the image carriers.

Furthermore, the present invention provides an image forming apparatus comprising: an image transfer carrying means having flexibility and having an endless sleeve-like shape; and a plurality of image forming means which are arranged along the image transfer carrying means such that respective image carriers thereof are in contact with the image transfer carrying means, each image forming means comprising a latent image forming means for forming a latent image on the image carrier and a developing means for developing the latent image formed on the image carrier, the image forming apparatus being characterized in that the toner images of the respective image forming means are transferred and superposed on the image transfer carrying means one by one, and the image forming means and image transfer carrying means are positioned in such a positional relation that the image transfer carrying means is in contact with the image carriers in the wrapping state to form nips, and the apparatus further comprising a tension adjusting means for adjusting the tension of the image transfer carrying means.

The image forming apparatus of the present invention is characterized in that said tension adjusting means is one of a plurality of rollers around which the image transfer carrying means is laid and is driven, wherein said one roller has a tension applying function, that said the image transfer carrying means is laid around two rollers and is driven, wherein at least one of the rollers has a tension applying function, and that said contact pressure is controlled by the wrapping angle defined according to the positional relation or by the tension produced by the roller having the tension applying function, and is further characterized in that said image transfer carrying means has a conductive layer at least on its surface to be in contact with the image carriers so that the energization is achieved through the conductive layer or that said image transfer carrying means is formed of a conductive member so as to achieve the energization.

The image forming apparatus of the present invention is characterized in that transfer bias applying means composed of conductive rollers which rotate according to the movement of the image transfer carrying means, conductive electric members, or conductive brushes are disposed on the back of the image transfer carrying means at positions of contact portions with the image carriers.

The image forming apparatus of the present invention is characterized in that said image forming means and said image transfer carrying means are disposed such that the lower side surface of the image transfer carrying means is in contact with the image carriers, and that said image transfer carrying means is an intermediate transfer medium or a sheet carrying medium which attracts and carries a sheet on its surface so that toner images are transferred and superposed on the sheet.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DETAILED DESCRIPTION OF THE PREFERRED EMBODIMENTS

Figure 2:
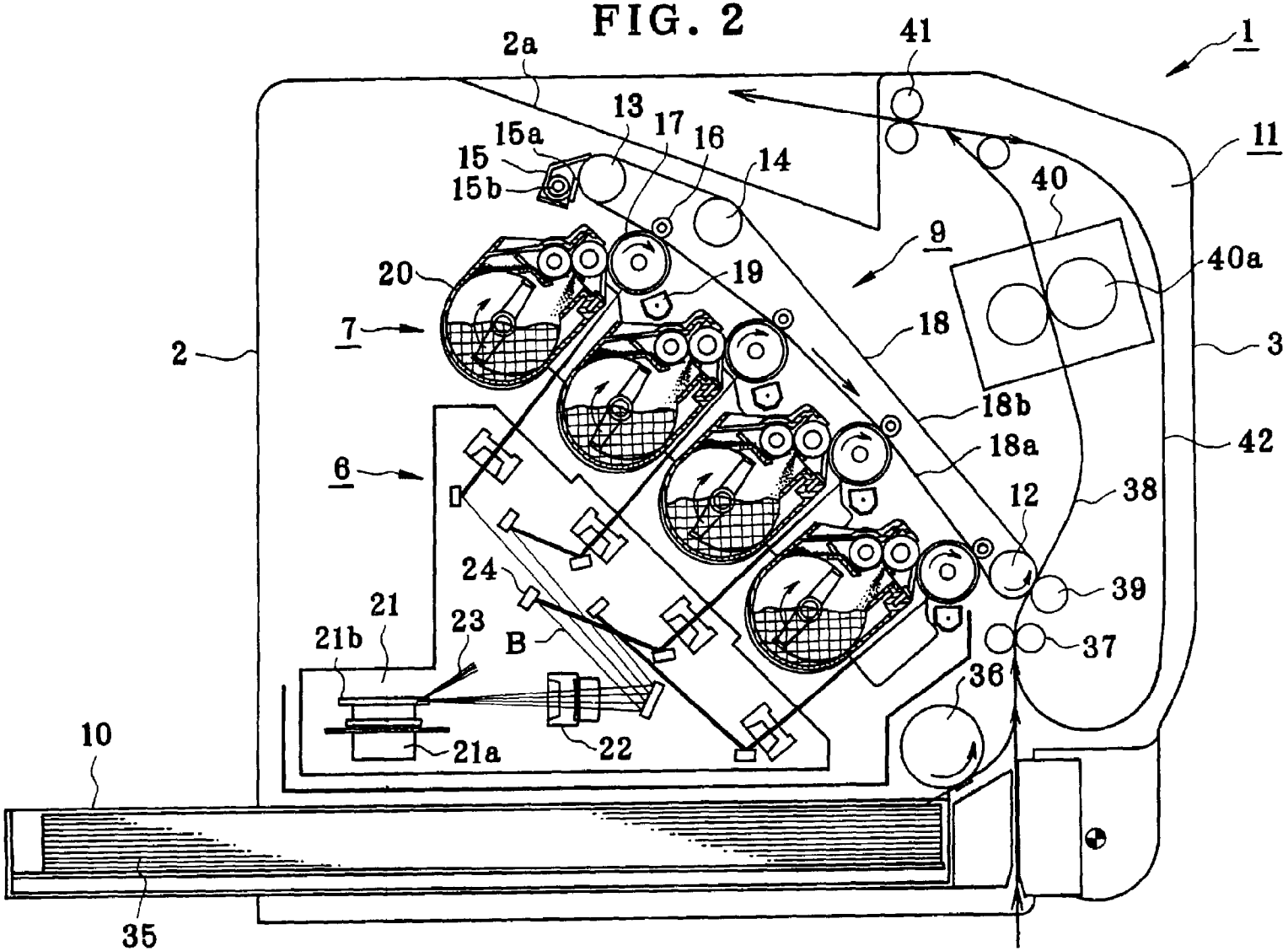
FIG. 2 is schematic sectional view showing the entire structure of an embodiment of an image forming apparatus of the present invention.
Figure 3:
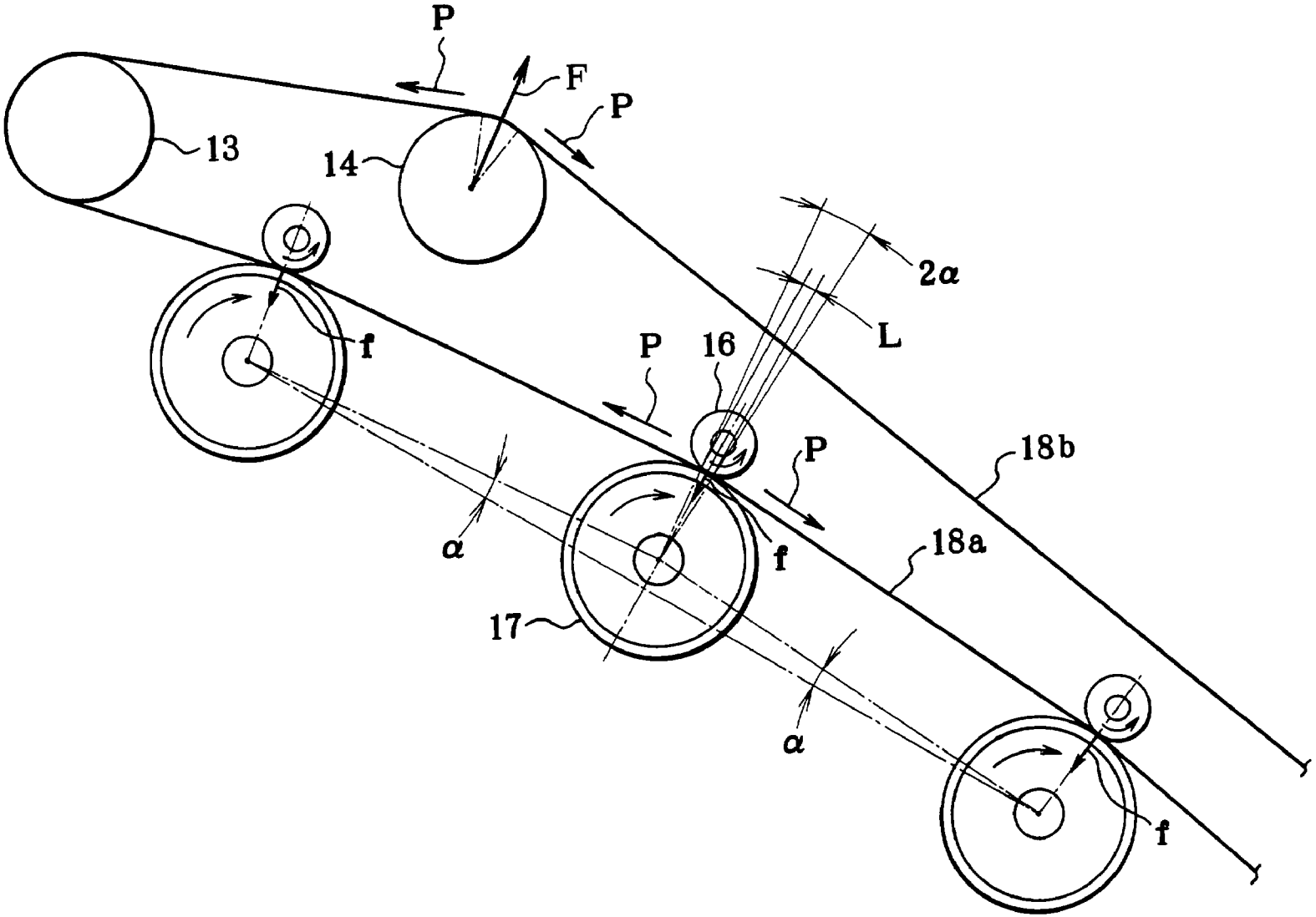
FIG. 3 is an illustration for explaining the contact pressure to be defined by the angle of wrapping an image transfer carrying means onto an image carrier and the tension of the image transfer carrying means.
Figure 4:
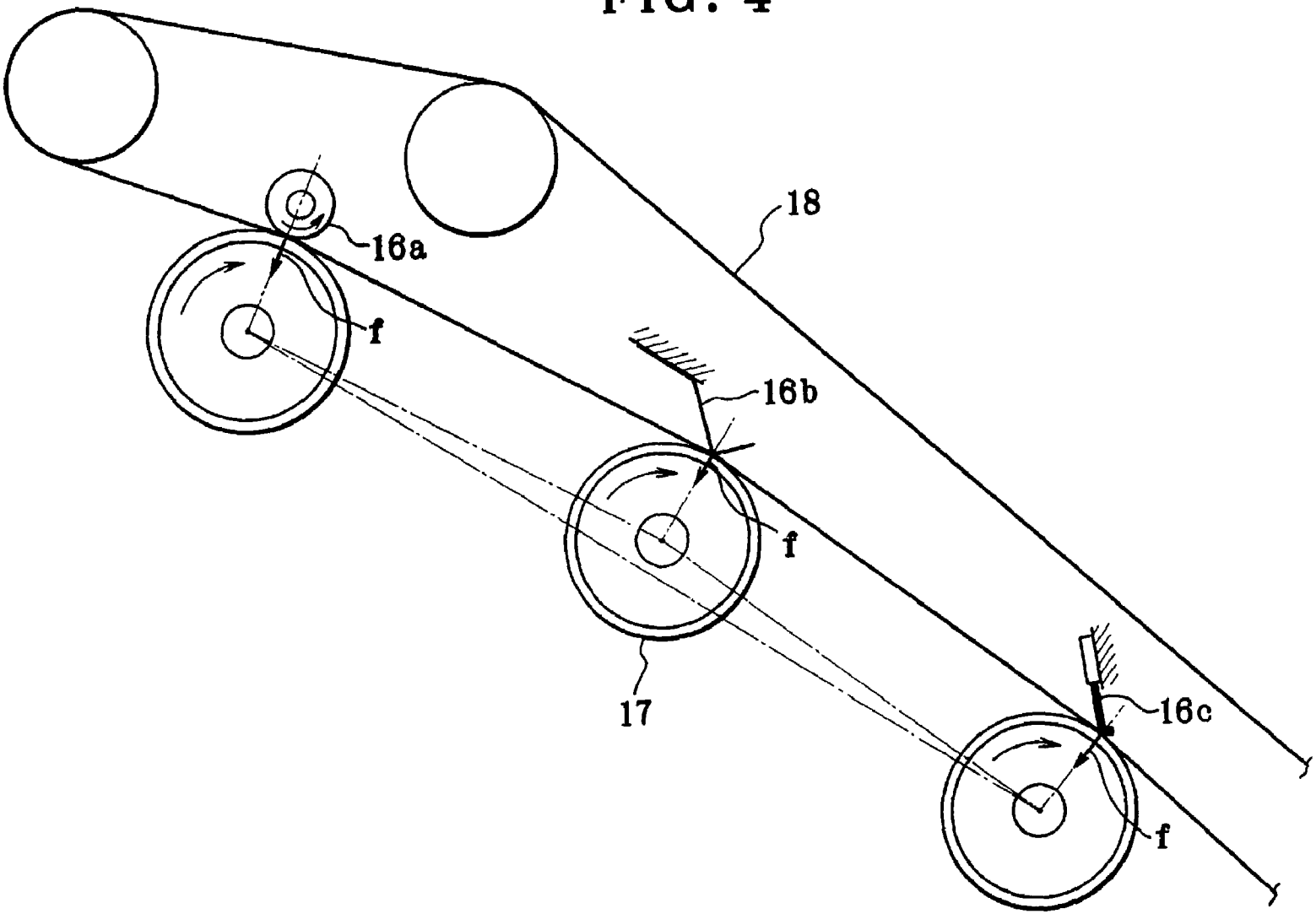
FIG. 4 is an illustration showing a structural example of a primary transfer bias applying means.
Figure 5:
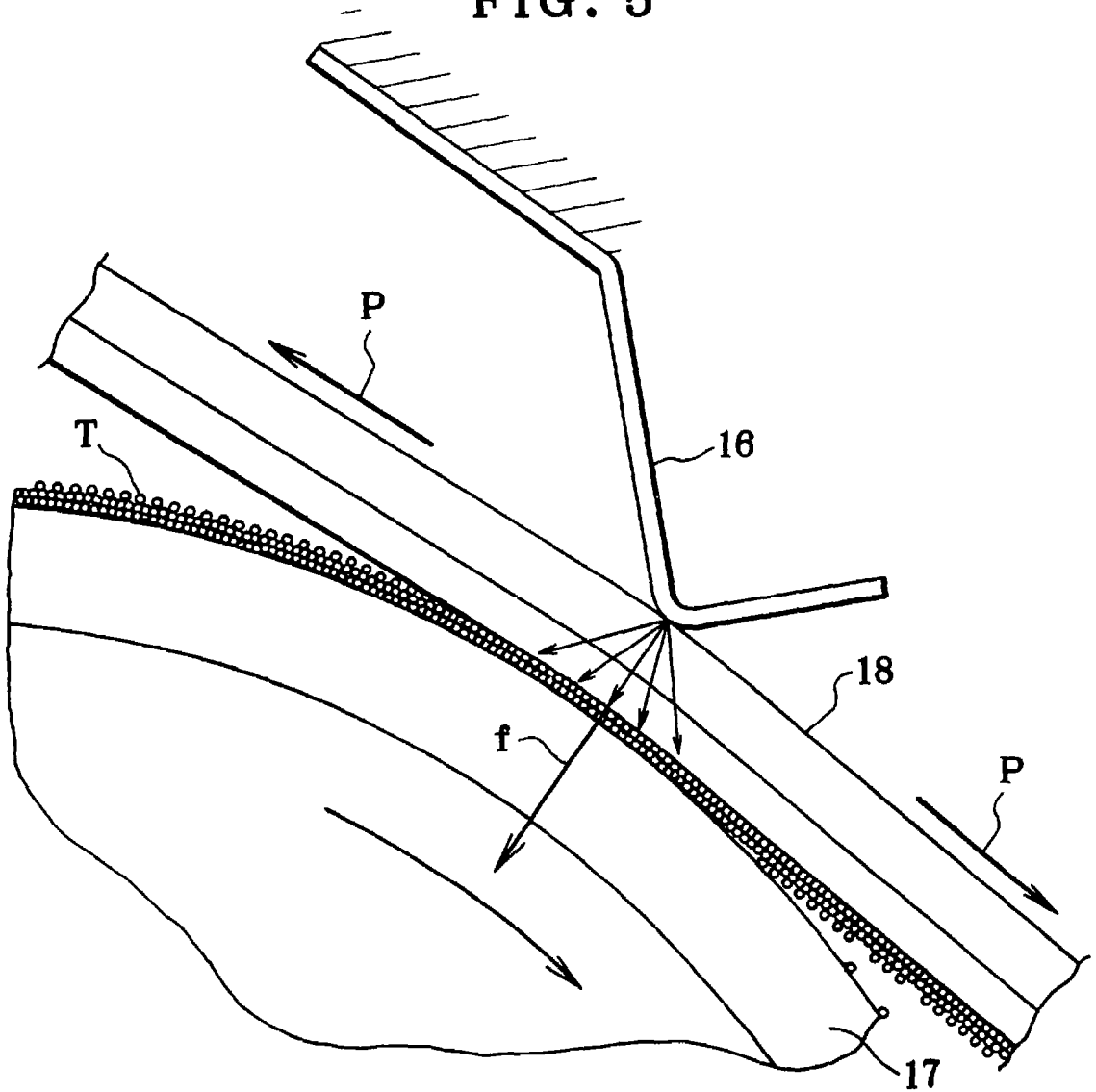
FIG. 5 is an illustration showing current paths from the primary transfer bias applying means to the image carrier when a bias is applied to a range narrower than the nip.
Figure 6:
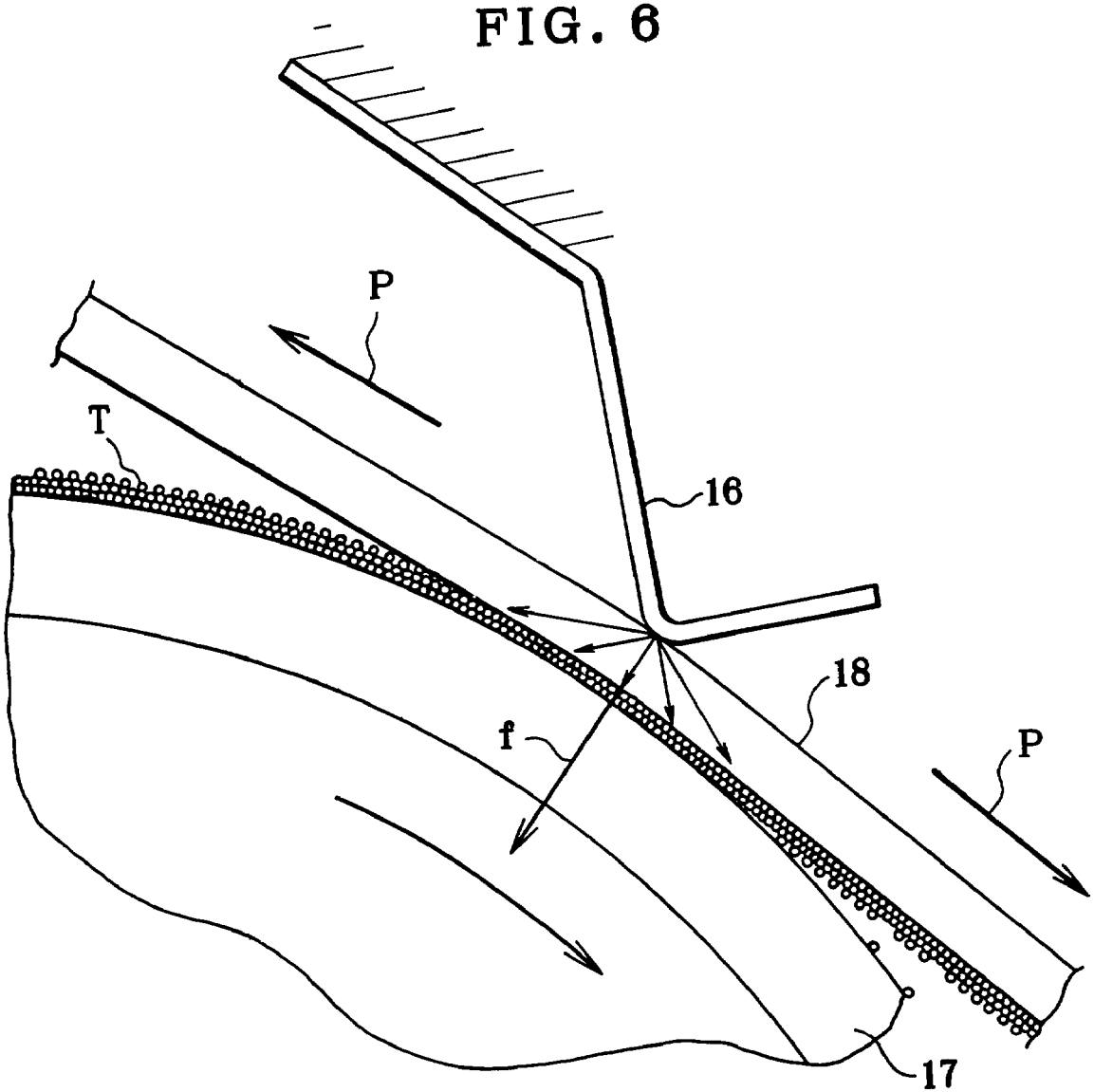
FIG. 6 is an illustration showing current paths from the primary transfer bias applying means to the image carrier when a bias is applied to a range narrower than the nip.

Hereinafter, embodiments of the present invention will be described with reference to the drawings. FIG. 2 is schematic sectional view showing the entire structure of an embodiment of an image forming apparatus of the present invention, FIG. 3 is an illustration for explaining the contact pressure to be defined by the angle of wrapping an image transfer carrying means onto an image carrier and the tension of the image transfer carrying means, FIG. 4 is an illustration showing a structural example of a primary transfer bias applying means, and FIG. 5 and FIG. 6 are illustrations showing current paths from the primary transfer bias applying means to the image carrier when a bias is applied to a range narrower than the nip. In this drawings, numeral 1 designates an image forming apparatus, 2 designates a housing, 3 designates a door body, 6 designates an exposure unit, 7 designates an image forming unit, 9 designates a transfer belt unit, 10 designates a sheet supply unit, 11 designates a sheet handling unit, 15 designates a cleaning means, 17 designates image carriers, 18 designates an image transfer carrying means, 20 designates developing means, 21 designates a scanning means, 21*b* designates a polygon mirror, and 40 designates a fixing means.

In FIG. 2, the image forming apparatus 1 of this embodiment comprises the housing 2, an out feed tray 2*a* which is formed in the top of the housing 2, a door body 3 which is attached to the front of the housing 2 in such a manner that the door body is able to open or close freely. Arranged within the housing 2 are the exposure unit (exposure means) 6, the image forming unit 7, the transfer belt unit 9 having the image transfer carrying means, and the sheet supply unit 10. Arranged inside the door body 3 is a sheet handling unit 11. The respective units are designed to be detachable relative to the apparatus. In this case, each unit can be detached from the apparatus for the purpose of repair or replacement.

The image forming unit 7 comprises the image forming stations Y (for yellow), M (for magenta), C (for cyan), and K (for black) for forming multi-color images (in this embodiment, four-color images). Each image forming station Y, M, C, K has an image carrier 17 composed of a photosensitive drum, a charging means 19 composed of a corona charging means, and a developing means 20 which are arranged around the image carrier 17. The image forming stations Y, M, C, K are arranged along an arcuate oblique line below the transfer belt unit 9 such that the image carriers 17 are positioned at the upper side. It should be understood that the image forming stations Y, M, C, K may be arranged in any order.

The transfer belt unit 9 comprises a driving roller 12 which is disposed in a lower portion of the housing 2 and is driven by a driving means (not shown) to rotate, a driven roller 13 which is disposed diagonally above the driving roller 12, a backup roller (tension roller) 14, an image transfer carrying means 18 composed of an intermediate transfer belt which is laid around at least two rollers with certain tension and is driven to circulate in a direction indicated by an arrow X (the counter-clockwise direction), and a cleaning means 15 which abuts on the surface of the image transfer carrying means 18. The driven roller 13, the backup roller 14, and the image transfer carrying means 18 are arranged obliquely to the upper left of the driving roller 12 as seen in FIG. 2. Accordingly, during the operation of the image transfer carrying means 18, a belt face 18*a* of which traveling direction X is downward takes a lower side and a belt face 18*b* of which traveling direction is upward takes an upper side.

Therefore, the image forming stations Y, M, C, K are arranged obliquely to the upper left of the driving roller 12. The respective image carriers 17 are aligned along the arcuate line to abut on the belt face 18*a*, of which traveling direction is downward, of the image transfer carrying means 18. Each image carrier 17 is driven to rotate in the traveling direction of the image transfer carrying means 18 as indicated by arrows. Since the image transfer carrying means 18 having an endless sleeve-like shape and having flexibility is disposed on the image carriers 17 such that the image transfer carrying means 18 is wrapped on the respective image carriers 17 at the same wrapping angle, the pressure and the nip width between the image carriers 17 and the image transfer carrying means 18 can be adjusted by controlling the tension to be applied to the image transfer carrying means 18 by the tension roller 14, the distance between adjacent image carriers 17, and the wrapping angle (the curvature of the arcuate line).

The driving roller 12 also functions as a backup roller for a secondary transfer roller 39. Formed on the peripheral surface of the driving roller 12 is, for example, a rubber layer which is 3 mm in thickness and $10^5$ Ω·cm or less in volume resistivity. The driving roller 12 has a metallic shaft which is grounded so as to function as a conductive path for secondary transfer bias supplied through the secondary transfer roller 39. Since the driving roller 12 is provided with the rubber layer having high friction and shock absorption, impact generated when a receiving medium is fed into a secondary transfer section is hardly transmitted to the image transfer carrying means 18, thereby preventing the deterioration of image quality. In addition, the diameter of the driving roller 12 is set to be smaller than the diameter of the driven roller 13 and also smaller than the diameter of the backup roller 14. This facilitates the separation of a receiving medium after secondary transfer because of the elastic force of the receiving medium itself. The driven roller 13 also functions as a backup roller for the cleaning means 15 described later.

Figure 1:
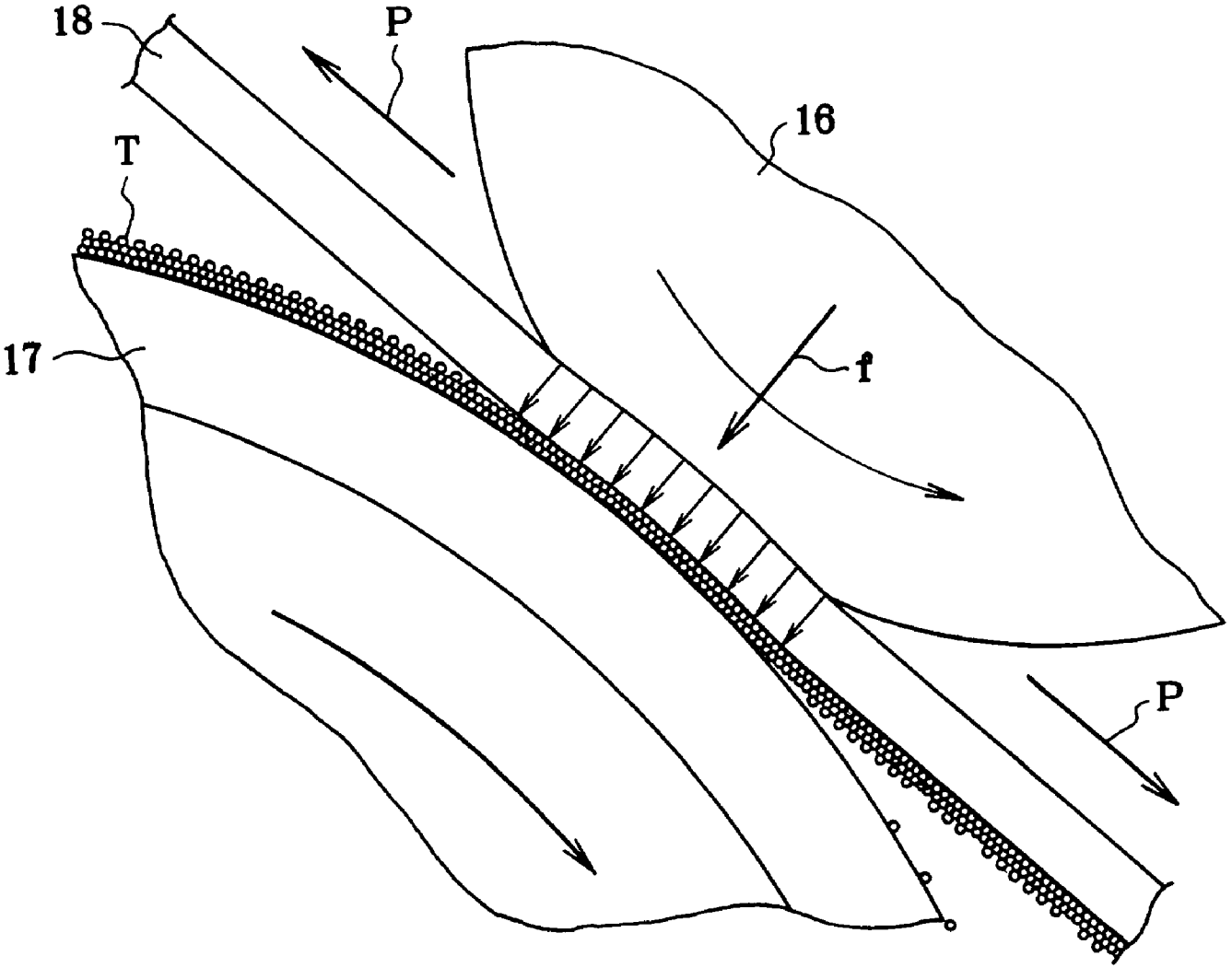
FIG. 1 is an illustration for explaining the phenomenon of image deterioration due to the transfer bias at a nip.

It should be noted that the image transfer carrying means 18 may be arranged in an obliquely rightward direction relative to the driving roller 12 in the drawing. In this case, the respective image forming stations Y, M, C, K are arranged along an arcuate line extending in an obliquely rightward direction relative to the driving roller 12 in drawing. That is, these components may be arranged symmetrically with those in FIG. 1.

Description will now be made as regard to the contact pressure to be applied by the wrapping angle and tension of the image transfer carrying means relative to the image carrier 17. As shown in FIG. 3, as a tension P is applied to the image transfer carrying means 18 by a biasing force F of the backup roller 14 as a tension roller, the contact pressure $f$ depends on the wrapping angle $\alpha$ of the image transfer carrying means 18 relative to the image carrier 17 so that the contact pressure $f$ is obtained as a component force of the tension P by the following equation:

$$f=P\cdot\sin\alpha$$

The contact pressure $f$ is applied to the contact portion between each image carrier 17 and the belt face 18*a* of the image transfer carrying means 18. Therefore, the contact pressure $f$ can be adjusted by controlling the biasing force F of the backup roller 14 to vary the tension P. The contact pressure $f$ can be adjusted also by controlling the wrapping angle $\alpha$ of the image transfer carrying means 18 relative to the image carrier 17. At the same time, by controlling the wrapping angle $\alpha$ of the image transfer carrying means 18 relative to the image carrier 17, the nip width L is also adjusted. When it is structured such that the wrapping angles $\alpha$ of the image transfer carrying means 18 relative to the respective image carriers 17 are different from each other, different contact pressures $f$ and different nip widths L according to the respective angles can be obtained.

For example, the tension P is set to a desired value required for stable operation of the image transfer carrying means 18 and the contact pressure $f$ acting on the nip portions can be set to a desired value by adjusting an angle (wrapping angle) $\alpha$ defined between lines extending through the centers of the image carriers 17. The value of the tension P required for stable operation of the endless sleeve-like image transfer carrying means 18 having flexibility may be set according to the characteristics of its material. In case of a material having higher rigidity, larger tension P is required to stabilize the tensioned state of the image transfer carrying means 18, while it is desired to set the tension to such a range as not to create permanent deformation and/or creep at wrapping portions on the rollers. On the other hand, in case of a material having poor rigidity, the tensioned state of the image transfer carrying means 18 can be easily stabilized even with small tension and a lager allowable range for permanent deformation and creep at wrapping portions on the rollers can be obtained. However, it is desirable to set the tension to a value corresponding to the driving force for achieving stable operation when the image transfer carrying means laid onto the rollers is driven.

Examples of suitable materials of the image transfer carrying means are a PC resin, a PET resin, a polyimide resin, an urethane resin, a silicone resin, a polyether resin, a polyester resin, and the like. It should be understood that some suitable additives may be added in order to obtain desired characteristics such as conductivity, rigidity, surface roughness, friction coefficient, or the like. The rigidity can be set to a desired value also by controlling the thickness of the image transfer carrying means.

In this embodiment, the image transfer carrying means is made of an urethane resin and a polyether resin to have relatively small rigidity so that neither permanent deformation nor creep is created, the tension P is set to 40N by the biasing force F of the roller, and the wrapping angle $\alpha$ relative to the image carriers is set to 4°. Accordingly, the contact pressure $f$ acting on the nip portions is set in the order of 2.8N (=40N×sin 4°). In this manner, a stable transfer condition is obtained. In view of the aforementioned materials, it is confirmed that a desired transfer condition can be obtained by satisfying that the tension P is set in a range of 10N–100N by the biasing force F of the roller and that the wrapping angle $\alpha$ relative to the image carriers is set in a range of 4°–15°.

In the image forming apparatus of this embodiment, the plurality of image carriers 17 are arranged in a line and the endless sleeve-like image transfer carrying means 18 having flexibility is laid around at least two rollers 12, 13 and is arranged to be in contact with the image carriers 17 and to have the predetermined wrapping angle relative to the image carriers 17. A tension is applied to the image transfer carrying means 18 by either of the rollers 12, 13. Toner images on the image carriers 17 are transferred to the image transfer carrying means 18 and are sequentially superposed on each other. Accordingly, predetermined nips are easily formed at contact portions between the image carriers 17 and the image transfer carrying means 18 according to the wrapping angle and the contact pressure at the contact portions are applied according to the wrapping angle.

The image carriers 17 are arranged in a line, and the endless sleeve-like image transfer carrying means 18 having flexibility is laid around at least two rollers 12, 13 and is arranged to be in contact with the image carriers 17 and to have substantially equal wrapping angles relative to the respective image carriers 17. A tension is applied to the image transfer carrying means 18 by either of the rollers 12, 13. Toner images on the image carriers 17 are transferred to the image transfer carrying means 18 and are sequentially superposed on each other. Accordingly, the substantially equal nips are easily formed at contact portions between the image carriers 17 and the image transfer carrying means 18 according to the substantially equal wrapping angles and the contact pressures at the contact portions are set substantially equal to each other according to the substantially equal wrapping angles.

Primary transfer members 16 are provided as transfer bias applying means for forming an image by sequentially transferring toner images to be superposed on each other and are disposed at positions to abut on the inner surface of the image transfer carrying means 18. There is no need to apply pressure to form transfer nips because the aforementioned contact pressures $f$ are already applied. It is enough that the primary transfer members 16 lightly touch the image transfer carrying means 18 because the primary transfer members 16 just serve as means for ensuring energization. Therefore, each primary transfer member 16 may be a conductive roller to be driven by contact with the image transfer carrying means or a rigid contact shoe, alternatively a conductive elastic member such as a plate spring, or a conductive brush made of fibers such as a resin as shown by numerals 16*a*–16*c* in FIG. 4. Accordingly, the sliding resistance between the primary transfer member and the image transfer carrying means should be small, thus not only increasing the lives of them but also reducing the manufacturing cost. Since it is not required to apply pressure, the contact width can be narrower so that the primary transfer member 16 may be in contact with the image transfer carrying means 18 in a range narrower than the nip portion to apply transfer bias as shown in FIG. 5 and FIG. 6. Shown in FIG. 5 is an example in which the image transfer carrying means 18 has a conductive layer at least on its surface to be in contact with the image carriers 17 so that the energization is achieved through the conductive layer. Shown in FIG. 6 is an example in which the image transfer carrying means 18 is formed of a conductive member so that the energization is achieved through the conductive member.

According to the structure that the primary transfer member 16 abuts the image transfer carrying means 18 to have a contact area narrower than the nip width for applying transfer bias, the transfer currents from the primary transfer member 16 via the image transfer carrying means 18 flow through current paths of different lengths from the contact portion between the primary transfer member 16 and the image transfer carrying means 18 to the image carrier 17 as shown in FIG. 5 and FIG. 6. The current flowing through the shortest path at the center from the contact point to the nip portion has largest current value, while currents flowing through longer paths outside the center have smaller values. The distribution of currents indicates that the current value is reduced in inverse proportion to the length of path. Therefore, even with high transfer bias voltage, no discharge phenomenon as mentioned above occurs at the entrance end and the exit end of the nip portion where the image transfer carrying means 18 and the image carrier are gradually spaced apart from each other, thereby preventing such an undesired phenomenon of toner image scattering from predetermined positions and thus preventing the deterioration of image quality. In addition, the sliding resistance between the primary transfer member 16 and the image transfer carrying means 18 is reduced, thereby not only improving the lives of them but also reducing the manufacturing cost.

On the other hand, in a multi-color image forming apparatus, toner images of different colors are developed on a plurality of image carriers and are transferred to an image transfer carrying means which is driven in the state being in contact with the image carriers so that the toner images are superposed on each other, thereby forming a multi-color image. The transfer property required to transfer the toner images of different colors may depend on the color characteristics. In other words, the first toner image is transferred to the image transfer carrying means without toner image previously transferred on the image transfer carrying means, that is, the first toner image is directly transferred to the image transfer carrying means. However, the second toner image is transferred on or adjacent to the first toner image, that is, the second toner image is affected by the first toner image previously transferred. Accordingly, the preferable transfer condition may be different from that for the first toner image. Similarly, the n-th toner image is transferred in a state affected by the (n-1)-th toner image and more previous one(s). The preferable transfer condition may be different from that for the first toner image or the previously transferred toner image. The larger the number of toner images previously superposed is, the lower the transfer efficiency is.

Accordingly, the amount of residual toner after a toner image is transferred from the image carrier to the image transfer carrying means may vary depending on the order transferred. Though a toner image is transferred from the image carrier to the image transfer carrying means under normal circumstances, the toner image may be reversely transferred to the image carrier due to discharge of transfer bias when the image transfer carrying means is about to depart from the image carrier so that the toner may be added to the residual toner. Since such residual toner and reversely transferred toner may lead to color mixture in the image forming process to be repeatedly conducted, the existence of such toner is undesirable. As compared to light color, deep color has larger effect on the image when color mixture occurs because of difference in toner characteristics. For example, in the toner color composition consisting of four colors: Y (yellow), M (magenta), C (cyan), and K (black), the black K which is a deep color has larger effect on the image when color mixture occurs, as compared to the yellow Y which is a light color.

As toner images are superposed one by one so as to increase the number of toner layers, the thickness of the toner layers is increased. According to the increase in thickness of the toner layers, difference in peripheral velocity at the transferring portion is increased, thus increasing the shifting amount of the transferred position of toner image. That is, the transferred position of the n-th toner image may be shifted gradually from the transferred position of the first toner image, thereby forming an image with color registration error.

To avoid this problem, the wrapping angles of the image transfer carrying means relative to the image carriers are set to be different to correspond to the transferring order for sequentially transferring toner images of plural colors and the characteristics of toner such that a suitable transfer condition is selected corresponding to the transferring order. For example, as the wrapping angle is increased, the nip width and the contact pressure are both increased at the contact portion between the image carrier and the image transfer carrying means. By setting the image transfer carrying means such that the wrapping angles relative to the respective image carriers become larger proportionally with the transferring order, the transfer properties which may decrease according to the number of superposed toner layers can be adjusted to be uniformed, thus enabling the use of a common power source to supply transfer biases to a plurality of transferring portions and thus obtaining great merit.

As for the image carrier 17 and the image transfer carrying means 18 which is driven in the state abutting on the image carriers 17, the peripheral velocities at the contact portions are preferably the same. However, it is unrealistic that the peripheral velocities are completely set to the same, because the peripheral velocities depend on variation in outer diameter and concentricity of image carriers 17 and/or concentricity of driving means, and variation in diameter of the driving roller 12 or variation of driving means for the image transfer carrying means 18 in mass production.

If the moving velocity of the image transfer carrying means 18 and the moving velocity of the image carriers 17 are set to be equal, these moving velocities may be faster or slower relative to the other because of the aforementioned variations in mass production. This is undesirable in setting the transfer conditions. The velocity difference is preferably set to be shifted to only one side relative to the image carriers 17. With excessive velocity difference, the position of a toner image may be shifted when the toner image carried by the image carrier 17 is transferred to the image transfer carrying means 18, thus making the image out of registration. Therefore, it is preferable to set as small velocity difference as possible.

For setting the image transfer carrying means 18 to have velocity difference to be shifted to one side relative to the plurality of image carriers 17, the abilities and the allowance limits of image registration error in mass production should be taken into consideration. Accordingly, it is preferable to set the velocity of the image transfer carrying means 18 to be in the order of ±(direction) 3±(variation) 2% relative to the moving velocity of the image carriers 17.

When the moving velocity of the image carriers 17 and the moving velocity of the image transfer carrying means 18 are equal to each other, toner images are transferred because of electric energy of the transfer biases. When the velocity difference as mentioned above is set, mechanical scrapping action is added to the electric energy, thereby improving the transfer efficiency. The process of cleaning residual toner remaining on the image carriers 17 after the transfer can be eliminated or simplified.

As a velocity difference is set between the moving velocity of the image carriers 17 and the moving velocity of the image transfer carrying means 18, looseness may be undesirably created between the image transfer carrying means 18 and the driving roller 12 or between the nip portions of the image transfer carrying means 18 relative to the image carriers 17. To avoid this problem, when the velocity of the image transfer carrying means 18 is shifted to be faster than that of the image carriers 17, the driving roller 12 for the image transfer carrying means 18 is located at the downstream side and, when the velocity of the image transfer carrying means 18 is shifted to be slower than that of the image carriers 17, the driving roller 12 for the image transfer carrying means 18 is located at the upstream side. This arrangement can prevent the creation of looseness and enables the setting of preferable transfer condition.

Also in case that the velocity difference is set, the superposition of toner images increases the number of toner layers so as to increase the thickness of the toner layers. According to the increase in thickness of the toner layers, difference in peripheral velocity at the transferring portion is increased, thus increasing the shifting amount of the transferred position of toner image. That is, the transferred position of the n-th toner image may be shifted gradually from the transferred position of the first toner image, thereby forming an image with color registration error. In this case, the wrapping angles of the image transfer carrying means relative to the image carriers are set to be gradually reduced in the transferring order, thereby preventing the occurrence of registration error due to the increase in thickness of toner layer according to the superposition of toner images.

In the color registration error appeared in the image, the deeper the color of registration error is, the more conspicuous the error is. For this, the transfer of an image of deep color such as K (black) is preferably conducted at the downstream side, thereby making the arrangement that the wrapping angles of the image transfer carrying means relative to the image carriers are gradually reduced in the transferring order more suitable for forming an image with excellent color registration. Based on the same concept, the transfer of an image of light color such as Y (yellow) is preferably conducted at the upstream side. In order to compensate differences in transfer characteristics if any, the transfer biases are suitably set according to the transfer portions, respectively.

The cleaning means 15 is located at the belt face 18*a* side, of which traveling direction is downward. The cleaning means 15 comprises a cleaning blade 15*a* for removing toner remaining on the surface of the image transfer carrying means 18 after the secondary transfer, and a toner carrying member 15*b* for carrying collected toner. The cleaning blade 15*a* is in contact with the image transfer carrying means 18 at a position where the image transfer carrying means is wrapped around the driven roller 13. On the back of the image transfer carrying means 18, primary transfer members 16 are disposed and brought into contact with the back of the image transfer carrying means 18 at locations corresponding to image carriers 17 of respective image forming stations Y, M, C, and K, described later. A transfer bias is applied to each primary transfer member 16.

The exposure means 6 is disposed in a space formed obliquely below the image forming unit 7 which is arranged obliquely. The sheet supply unit 10 is disposed below the exposure means 6 and at the bottom of the housing 2. The exposure means 6 has a casing 18 for accommodating the entire exposure means 6 which is arranged in a space formed obliquely below the belt face of which traveling direction is downward. At the bottom of the casing 18, a single scanner means 21, composed of a polygon mirror motor 21*a* and a polygon mirror 21*b*, is disposed horizontally. In an optical system B, laser beams from a plurality of laser beam sources 23 are directed to the image carriers 17 after reflected at the polygon mirror 21*b*. In the optical system B, a single f-θ lens 22 and reflective mirrors 24 are disposed to make scanning lines y, m, c, k which are not parallel to each other toward the image carriers 17.

In the exposure means 6 having the aforementioned structure, image signals corresponding to the respective colors are formed and modulated according to the common data clock frequency and are then radiated as laser beams from the polygon mirror 21*b*. The radiated image signals are aimed to the image carriers 17 of the image forming stations Y, M, C, K via the f-θ lens 22, the reflection mirror 23, and the reflective mirrors 24, thereby forming latent images. By providing the reflective mirrors 24, the scanning lines y, m, c, k are bent, thereby lowering the height of the casing and thus making the apparatus compact. The reflective mirrors 24 are arranged in such a manner as to make the respective lengths of the scanning lines to the image carriers 17 of the image forming stations Y, M, C, K equal to each other. Since the respective lengths of the scanning lines (optical paths) from the polygon mirror 21*b* of the exposure means 6 to the image carriers 17 of the image forming units 7 are designed equal to each other, the scanning widths of light beams are also substantially equal to each other. Therefore, no special structure for forming the image signals is required. Though the laser beam sources must be modulated to correspond to images of different colors according to different image signals, respectively, the laser beam sources can be modulated based on a common data clock frequency. Since a common reflection facet is used, the occurrence of color registration error caused by relative shifts in the sub scanning direction can be prevented. Therefore, this achieves the production of a cheaper multi-color image forming apparatus with simple structure.

In this embodiment, the scanning optical system is arranged at a lower side of the apparatus, thereby minimizing the vibration of the scanning optical system due to vibration of the driving system of the image forming means which affects the frame supporting the apparatus and thus preventing the deterioration of image quality. In particular, by arranging the scanner means 21 at the bottom of the casing, vibration of the polygon motor 21*a* affecting the casing can be minimized, thereby preventing the deterioration of image quality. Since only a single polygon motor 21*a* is provided which is a source of vibration, vibration affecting the casing can be minimized.

Figure 7:
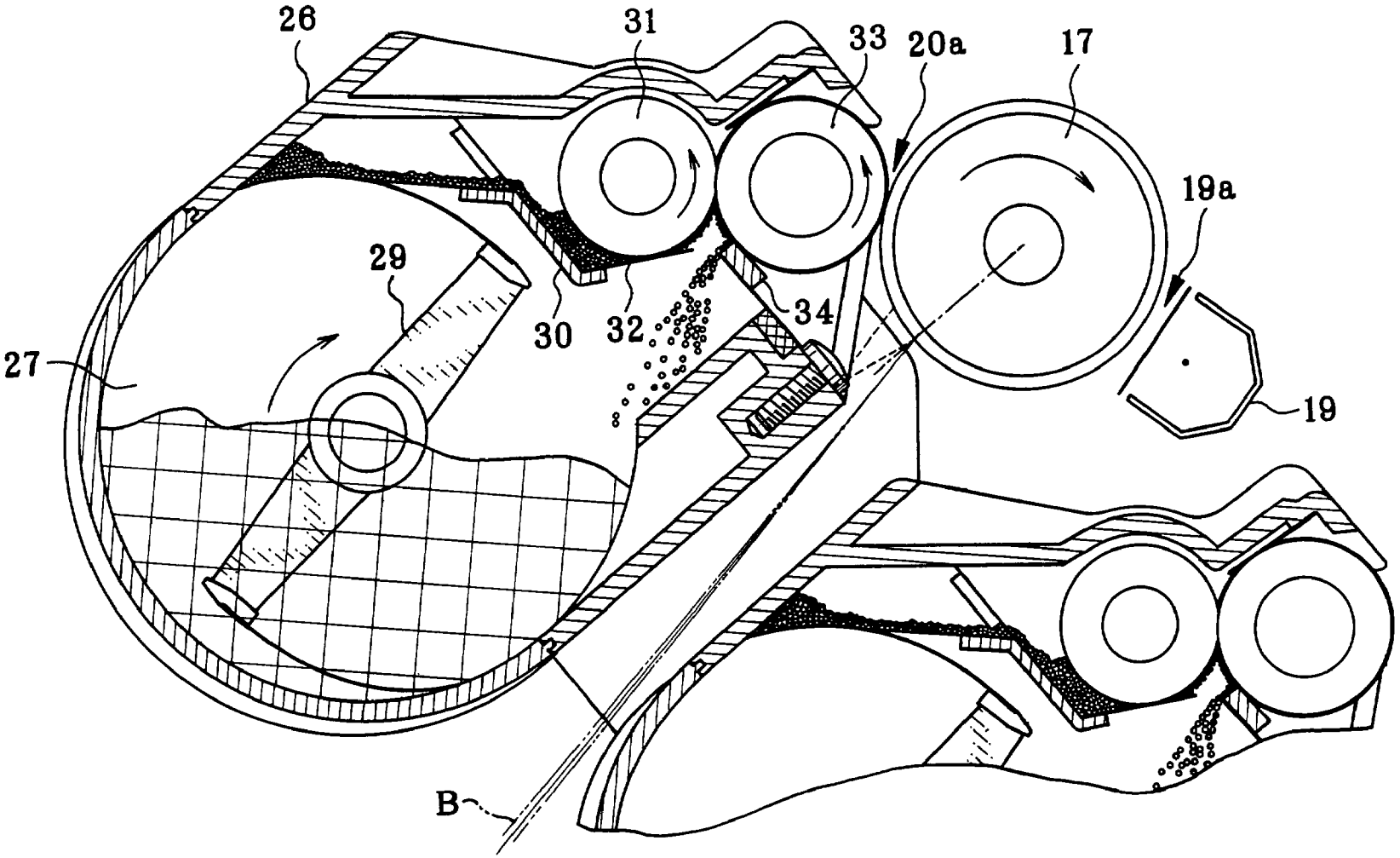
FIG. 7 is an enlarged sectional view of an image forming section composed of a developing means and an image carrier shown in FIG. 2.

In this embodiment, the respective image forming stations Y, M, C, K are arranged obliquely and the image carriers 17 are arranged along an arcuate oblique line at the upper side. Since the image carriers 17 are in contact with the belt face 18*a*, of which traveling direction is downward, of the image transfer carrying means 18, the toner containers 26 are arranged obliquely downward to the lower left of the image carriers 17. For this, special structure is employed in the developing means 20. FIG. 7 is an enlarged sectional view of an image forming section composed of a developing means and an image carrier shown in FIG. 2.

As shown in FIG. 7, the developing means 20 each comprises the toner container 26 storing toner (indicating by hatching), a toner storage area 27 formed in the toner container 26, a toner agitating member 29 disposed inside the toner storage area 27, a partition 30 defined in an upper portion of the toner storage area 27, a toner supply roller 31 disposed above the partition 30, a flexible blade 32 attached to the partition 30 to abut the toner supply roller 31, the development roller 33 arranged to abut both the toner supply roller 31 and the image carrier 17, and a regulating blade 34 arranged to abut the development roller 33.

The image carrier 17 is rotated in the traveling direction of the image transfer carrying means 18. The development roller 33 and the supply roller 31 are rotated in a direction opposite to the rotational direction of the image carrier 17 as shown by arrows. On the other hand, the agitating member 29 is rotated in a direction opposite to the rotation of the supply roller 31. Toner agitated and scooped up by the agitating member 29 in the toner storage area 27 is supplied to the toner supply roller 31 along the upper surface of the partition 30. Friction is caused between the toner and the flexible blade 32 so that mechanical adhesive force and adhesive force by triboelectric charging are created relative to the rough surface of the supply roller 31. By these adhesive forces, the toner is supplied to the surface of the development roller 33. The toner supplied to the development roller 33 is regulated into a coating layer having a predetermined thickness by the regulating blade 34. The toner layer as a thin layer is carried to the image carrier 17 so as to develop a latent image on the image carrier 17 at and near a nip portion which is a contact portion between the development roller 33 and the image carrier 17.

In this embodiment, the development roller 33 disposed facing the image carrier 17, the toner supply roller 31, and the contact portion of the regulating blade 34 relative to the development roller 33 are not submerged in the toner. This arrangement can prevent the contact pressure of the regulating blade 34 relative to the development roller 33 from being varied due to the decrease of the stored toner. In addition, since excess toner scraped from the development roller 33 by the regulating blade 34 spills onto the toner storage area 27, thereby preventing filming of the development roller 33.

The contact portion between the development roller 33 and the regulating blade 34 is positioned below the contact portion between the supply roller 31 and the development roller 33. There is a passage for returning excess toner, which was supplied to the development roller 33 by the supply roller 31 but not transmitted to the development roller 33, and excess toner, which was removed from the development roller 33 by the regulating operation of the regulating blade 34, to the toner storage area 27 at the lower portion of the developing means. The toner returned to the toner storage area 27 is agitated with toner in the toner storage area 27 by the agitating member 29, and is supplied to a toner inlet near the supply roller 31 again. Therefore, the excess toner is let down to the lower portion without clogging the friction portion between the supply roller 31 and the development roller 33 and the contact portion between the development roller 33 and the regulating blade 34 with the excess toner and is then agitated with toner in the toner storage area 27, whereby the toner in the developing means deteriorates slowly so that portentous changes in image quality just after the replacement of the developing means is prevented.

The developing means 20 has a development roller aperture 20*a* disposed adjacent to the development roller 33. The corona charging means 19 as a charging means has an upward opening 19*a* which opens upwardly to the image carrier 17. If the upward opening 19*a* of the corona charging means 19 is positioned below the development roller aperture 20*a*, toner spills from the development roller aperture 20*a* because of the gravity and thus enters into the corona charging means 19 through the upward opening 19*a* so as to undesirably stain the corona charging means 19.

In this embodiment, the upward opening 19*a* of the corona charging means 19 is offset toward the image transfer carrying means 18 from the development roller aperture 20*a* of the developing means 20 such that the upward opening 19*a* does not overlap relative to the development roller aperture 20*a*. This can solve the possible problem that toner spills from the development. roller aperture 20*a* because of the gravity and thus enters into the corona charging means 19 through the upward opening 19*a* so as to undesirably stain the corona charging means 19.

The sheet supply unit 10 comprises a sheet cassette 35 in which a pile of receiving media P are held, and a pick-up roller 36 for feeding the receiving media P from the sheet cassette 35 one by one. The sheet handling unit 11 comprises a pair of gate rollers 37 (one of which is positioned on the housing 2 side) for regulating the feeding of a receiving medium P to the secondary transfer portion at the right time, the secondary transfer roller 39 as a secondary transfer means abutting and pressed against the driving roller 12 and the image transfer carrying means 18, a sheet feeding passage 38, the fixing means 40, a pair of out feed rollers 41, and a dual-side printing passage 42.

The fixing means 40 comprises a pair of fixing rollers 40*a* at least one of which has a built-in heating element such as a halogen heater and which are freely rotatable, and a pressing means for pressing at least one of the rollers against the other roller to press a secondary image secondarily transferred to the receiving medium P. The secondary image secondarily transferred to the receiving medium is fixed to the receiving medium at the nip portion formed between the fixing rollers 40*a* at a predetermined temperature. In this embodiment, the fixing means 40 can be arranged in a space formed obliquely above the belt face 18*b*, of which traveling direction is upward, of the image transfer carrying means, that is, a space formed on the opposite side of the image forming stations relative to the image transfer carrying means. This arrangement enables the reduction in heat transfer to the exposure means 6, the image transfer carrying means 18, and the image forming means and lessens the frequency of taking the action for correcting color registration error. In particular, the exposure means 6 is positioned farthest from the fixing means 40, thereby minimizing the deformation of the scanning optical components due to heat and thus preventing the occurrence of color registration error.

In this embodiment, since the image transfer carrying means 18 is disposed to be inclined relative to the driving roller 12, a large space is created on the right side of the image transfer carrying means 18 in the drawing. The fixing means 40 can be disposed in the space, thereby achieving the reduction in size of the apparatus. This arrangement also prevents the heat generated by the fixing means 40 from being transferred to the exposure unit 6, the image transfer carrying means 18, and the respective image forming stations Y, M, C, K which are located in the left side portion of the apparatus. Since the exposure unit 6 can be located in a space on the lower left side of the image forming unit 7, the vibration of the scanning optical system of the exposure unit 6 due to vibration of the driving system of the image forming means can be minimized and the deterioration of image quality can be prevented.

Further, in this embodiment, by employing spheroidized toner, the primary transfer efficiency is increased (approximately 100%). Therefore, no cleaning means for collecting residual toner after the primary transfer is used for the respective image carriers 17. Accordingly, the image carriers 17 composed of a photosensitive drum of which diameter is 30 mm or less can be arranged closely to each other, thereby reducing the size of the apparatus.

Because no cleaning device is used, the corona charging means 19 is employed as a charging means. When the charging means is a roller, residual toner after the primary transfer on the image carrier 17 (the amount of which should be small) is deposited on the roller, leading to insufficient charging. On the other hand, since the corona charging means 19 is a non-contact charging means, toner hardly adheres to the image carriers, thereby preventing the occurrence of insufficient charging.

Figure 8:
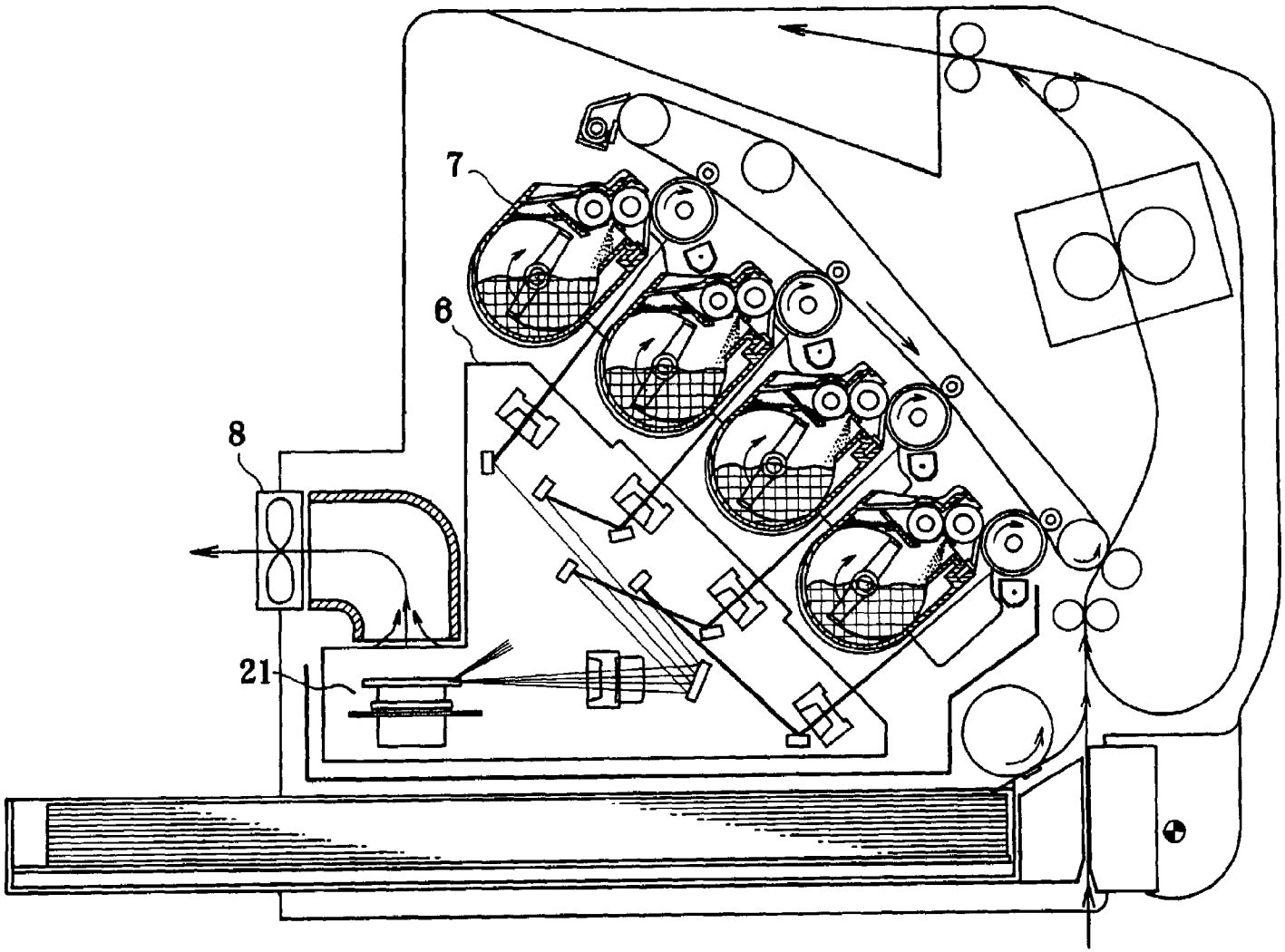
FIG. 8 is an illustration showing another embodiment of the present invention in which a cooling means is arranged above a scanning means.
Figure 9:
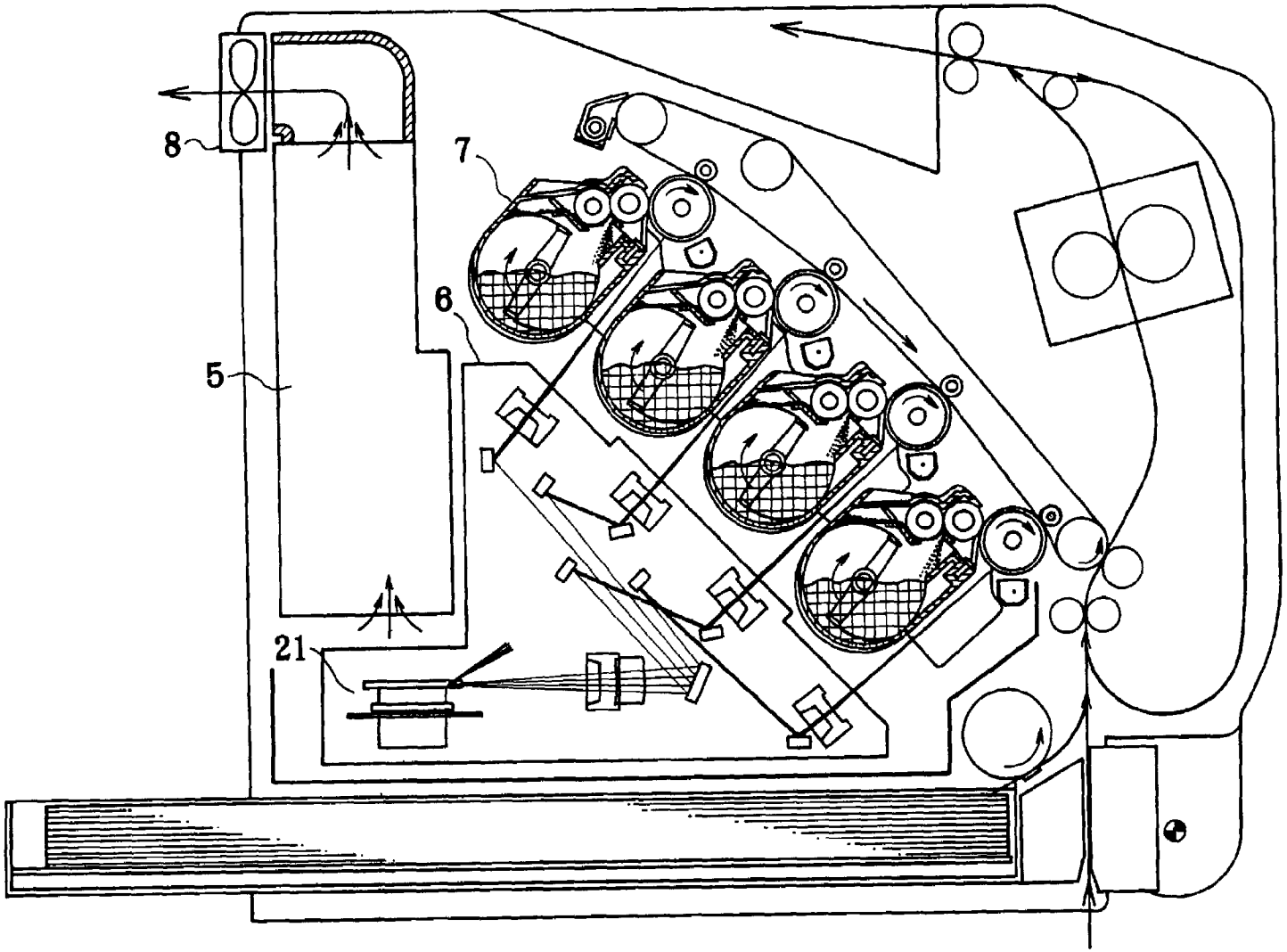
FIG. 9 is an illustration showing further another embodiment of the present invention in which a cooling means is arranged with a space for accommodating a control unit and a power source unit above a scanning means.
Figure 10:
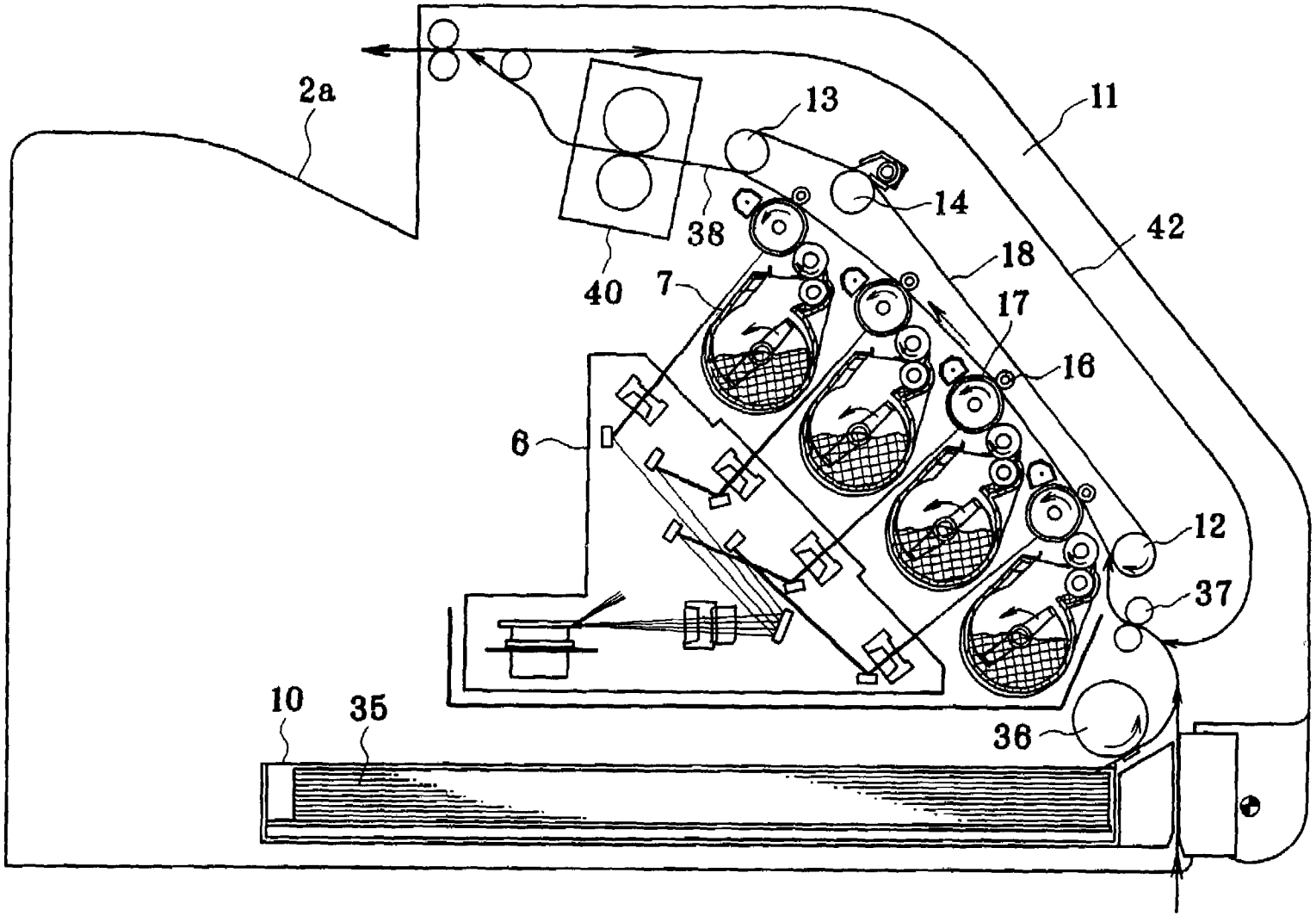
FIG. 10 is an illustration showing still another embodiment of the present invention in which the image transfer carrying means is a sheet carrying medium.

FIG. 8 is an illustration showing another embodiment of the present invention in which a cooling means is arranged above a scanning means, FIG. 9 is an illustration showing further another embodiment of the present invention in which a cooling means is arranged with a space for accommodating a control unit and a power source unit above a scanning means, and FIG. 10 is an illustration showing still another embodiment of the present invention in which the image transfer carrying means is a sheet carrying medium.

There is a problem that when the relative positions between the exposure device and the image forming stations are varied because a frame fixing the exposure device and a plurality of image carriers expands due to fluctuation in temperature, the pitch of the scanning line is varied corresponding to the relative angle between scanning lines because laser beams are not parallel. The variation in pitch of a scanning line shifts the scanning position on the image carrier. That is, the image positions are different from color to color, leading to occurrence of color registration error and thus significantly deteriorating the image quality.

Particularly, the number of revolutions of a polygon mirror recently increases to a region over the tens of thousands rpm with the improvement in printing speed and improvement in resolution of image forming apparatus. This increases load applied to a bearing of the polygon mirror. In this case, when the polygon mirror is arranged obliquely just like the conventional apparatus, a radial force is applied to the bearing only in the gravitational direction so that friction increases only at a portion to which the force is applied, thereby rising the temperature around the driving motor and the bearing. This rising in temperature must result in fluctuation in temperature within the apparatus, leading to occurrence of color registration error and thus deteriorating the image quality.

For this, in the aforementioned embodiment, the single scanner means 21 composed of the polygon mirror motor 21*a* and the polygon mirror 21*b* is arranged horizontally and located apart from the optical system composed the f-θ lens 22 and the reflective mirrors 24 in the vertical direction as well as the laser beam sources 23. By arranging the polygon mirror motor 21*a* and the polygon mirror 21*b* horizontally, a radial force to be applied to the bearing can be eliminated. Therefore, even when the load to be applied to the bearing increases because of the increase in number of revolutions with the improvement in printing speed and improvement in resolution of image forming apparatus, the rising in temperature around the bearing can be reduced.

By positioning the other components apart from elements of rising temperature such has the polygon mirror motor 21*a*, the bearing, and the laser beam sources 23 and providing a cooling means 8 composed of an air fan above the scanner means 21 as shown in FIG. 8 or providing a control portion 5 as a space for a control unit or a power source unit above the scanner means 21 and adjacent to the exposure means 6 and providing a cooling means 8 above the control portion 5, air inside the apparatus can be introduced in a direction of arrows in order to emit the heat from heating members such as the exposure means 6. Accordingly, since heat can be discharged out without passing through the space where the optical system is arranged, the temperature of the polygon motor 21*a* is prevented from increasing, thereby preventing the deterioration of image quality and increasing the lives of the polygon motor 21*a* and the bearing. The fluctuation in temperature of the apparatus due to the heat can be reduced, thereby providing high-quality images.

Though the image transfer carrying means 18 is structured as an intermediate transfer belt to be in contact with the image carriers 17 in the aforementioned embodiments, the image transfer carrying means 18 is structured as a sheet carrying belt to be in contact with the image carriers 17 in the embodiment of FIG. 10, in which the sheet carrying belt carries a sheet thereon and toner images are transferred and superposed on the sheet one by one, thereby forming an image. In this case, the different point from the aforementioned embodiments is the traveling direction of the sheet carrying belt as the image transfer carrying means 18. The traveling direction of the lower surface of the belt carrying belt, where the image carriers 17 are in contact with, is upward, which is opposite to the direction of the aforementioned embodiments.

While toner images are transferred and superposed on the intermediate transfer belt as the image transfer carrying means 18 one by one in the order from the uppermost image carrier 17 in the aforementioned embodiment, toner images are transferred and superposed on the sheet attracted and carried by the sheet carrying belt as the image transfer carrying means 18 one by one in the order from the lowermost image carrier 17 in this embodiment.

In addition, while the driven roller 13 is used also as the backup roller for the cleaning means 15 in the aforementioned embodiments, the roller 13 is a driving roller, the roller 12 is a driven roller, the roller 14 is a backup roller for a cleaning means 15 in this embodiment. Also in this embodiment, a fixing means 40 is located above the image forming portion to discharge heat to the above so that the fluctuation in temperature of the apparatus due to the heat can be reduced, thereby providing high-quality images.

The actions of the image forming apparatus as a whole will be summarized as follows:

(1) As a printing command (image forming signal) is inputted into the control unit of the image forming apparatus 1 from a host computer (personal computer) (not shown) or the like, the image carriers 17 and the respective rollers of the developing means 20 of the respective image forming stations Y, M, C, K, and the image transfer carrying means 18 are driven to rotate.

(2) The outer surfaces of the image carriers 17 are uniformly charged by the charging means 19.

(3) In the respective image forming stations Y, M, C, K, the outer surfaces of the image carriers 17 are exposed to selective light corresponding to image information for respective colors by the exposure unit 6, thereby forming electrostatic latent images for the respective colors.

(4) The electrostatic latent images formed on the image carriers 17 are developed by the developing means 20 to form toner images.

(5) The primary transfer voltage of the polarity opposite to the polarity of the toner is applied to the primary transfer members 16 of the image transfer carrying means 18, thereby transferring the toner images formed on the image carriers 17 onto the image transfer carrying means 18 one by one. According to the movement of the image transfer carrying means 18, the toner images are superposed on the image transfer carrying means 18.

(6) In synchronization with the movement of the image transfer carrying means 18 on which primary images are transferred, a receiving medium P accommodated in the sheet cassette 35 is fed to the secondary transfer roller 39 through the pair of resist rollers 37.

(7) The primary-transferred image meets with the receiving medium at the secondary transfer portion. A bias of the polarity opposite to the polarity of the primary transfer image is applied by the secondary transfer roller 39 which is pressed against the driving roller 12 for the image transfer carrying means 18 by a pressing mechanism (not shown), whereby the primary-transferred image is secondarily transferred to the receiving medium fed in the synchronization manner.

(8) Residual toner after the secondary transfer is carried toward the driven roller 13 and is scraped by the cleaning means 15 disposed opposite to the roller 13 so as to refresh the image transfer carrying means 18 to allow the above cycle to be repeated.

(9) The receiving medium passes through the fixing means 40, whereby the toner image on the receiving medium is fixed. After that, the receiving medium is carried toward a predetermined position (toward the outfeed tray 2*a* in case of single-side printing, or toward the dual-side printing passage 42 in case of dual-side printing).

Though the present invention has been described with reference to the embodiments disclosed herein, the present invention is not limited thereto and the components of the present invention may be replaced with or include conventionally known or well known techniques. For example, though the plurality of image carriers 17 are arranged along an arcuate oblique line and are in contact with the image transfer carrying means 18 in the aforementioned embodiments, the image carriers 17 may be arranged along an arcuate vertical line or an arcuate horizontal line and the line may be straight. In any case, the position of the polygon mirror motor 21*a* may be selected advantageously in view of heat by the arrangement of the reflective mirrors 24. The backup roller 14 may be omitted so that the image transfer carrying means 18 may be laid around the driving roller 12 and the driven roller 13 only. Though the driving roller 12 is located at the lower side and the driven roller 13 is located at the upper side in the above embodiments, the driven roller 13 may be located at the lower side and the driving roller 12 is located at the upper side. It should be noted that the image transfer carrying means is defined as a generic term used to refer to an intermediate transfer belt and a paper delivery belt in the present invention.

Though the latent image forming means is the exposure means in which the single polygon mirror is used to deflect laser beams from the laser beam sources toward the image carriers, respectively, the present invention is not limited thereto. For example, an exposure means having polygon mirrors corresponding to the respective image carriers, or a means including LED elements or EL elements connected and aligned in a line which are selectively subjected to light so as to form a latent image may be employed as the latent image forming means of the present invention, of course. Further, a means in which writing electrodes connected and aligned to have similar shape of a latent image are moved to slide on the image carriers so as to selectively apply voltage to electrodes or a means of other type may also be employed as the latent image forming means of the present invention.

As apparent from the above description, according to the present invention, an apparatus comprises an image transfer carrying means having flexibility and having an endless sleeve-like shape, a plurality of image forming means which are arranged along the image transfer carrying means such that respective image carriers thereof are in contact with the image transfer carrying means, each image forming means comprising a latent image forming means for forming a latent image on the image carrier and a developing means for developing the latent image formed on the image carrier, and transfer bias applying means which are disposed on the back of the image transfer carrying means at positions where the respective image carriers are in contact with the image transfer carrying means for applying transfer bias, wherein the image transfer carrying means is laid around at least two rollers with certain tension and is positioned to be in contact with the image carriers to have predetermined nip width therebetween and the transfer bias applying means each abut the image transfer carrying means to have a contact area narrower than the nip width for applying transfer bias. In this apparatus, at gradually increasing spaces at the entrance end and the exit end of each nip portion of the image transfer carrying means, even with high transfer bias voltage, no discharge phenomenon as mentioned above occurs, thereby preventing such an undesired phenomenon of toner image scattering from predetermined positions and thus preventing the deterioration of image quality. In addition, the sliding resistance between each transfer member and the image transfer carrying means is reduced, thereby not only improving the lives of them but also reducing the manufacturing cost.

As for the positional relation, the image transfer carrying means is arranged to be in contact with the image carriers from above and to have the predetermined wrapping angle relative to the image carrier. The image transfer carrying means has a conductive layer at least on its surface to be in contact with the image carriers so that the energization is achieved through the conductive layer. As the energization is achieved through the conductive member, the transfer bias applying means can be easily in contact with the area narrower than the nip width, whereby the transfer currents flow through current paths of different lengths from the contact portion just like a point to the nip portion. The current flowing through the shortest path at the center from the contact point to the nip portion has largest current value, while currents flowing through longer paths outside the center have smaller values such that the current value is reduced in inverse proportion to the length of path.

Further, an apparatus comprises an image transfer carrying means having flexibility and having an endless sleeve-like shape, and a plurality of image forming means which are arranged along the image transfer carrying means such that respective image carriers thereof are in contact with the image transfer carrying means, each image forming means comprising a latent image forming means for forming a latent image on the image carrier and a developing means for developing the latent image formed on the image carrier. In this apparatus, a contact pressure is defined and applied by the wrapping angle of the image transfer carrying means relative to the image carrier of each image forming means and by the tension of the image transfer carrying means so that the toner images of the respective image forming means are transferred and superposed on the image transfer carrying means one by one. Therefore, the contact pressure can be easily applied by control of the wrapping angle and tension of the image transfer carrying means without special means for applying a predetermined contact pressure between each image carrier and the image transfer carrying means.

By setting the wrapping angles of the image transfer carrying means relative to the image carrier of each image forming means to be substantially equal to each other, the substantially equal contact pressures can be obtained. The contact pressures are individually adjustable by controlling the respective wrapping angles.

The image transfer carrying means is set to have velocity difference relative to the image carriers of the image forming means, the image transfer carrying means is laid around at least two rollers, and the position of the driving roller is selected to the upstream side or the downstream side according to the velocity difference relative to the image carriers. Even though it is impossible to set the peripheral velocities to be completely equal, because the peripheral velocities depend on variation in outer diameter and concentricity of image carriers and/or concentricity of driving means, and variation in diameter of the driving roller or variation of driving means of the image transfer carrying means, the image transfer carrying means can be set to have a velocity difference to only one side relative to the image carriers, thereby preventing the creation of image distortion due to the color registration error.

In addition, mechanical scrapping action is added to the electric energy, thereby improving the transfer efficiency. The process of cleaning residual toner remaining on the image carriers after the transfer can be eliminated or simplified. Even when a velocity difference is set between the moving velocity of the image carriers and the moving velocity of the image transfer carrying means, looseness between the image transfer carrying means and the driving roller or between the nip portions of the image transfer carrying means relative to the image carriers can be prevented.

Furthermore, an apparatus comprises an image transfer carrying means having flexibility and having an endless sleeve-like shape, and a plurality of image forming means which are arranged along the image transfer carrying means such that respective image carriers thereof are in contact with the image transfer carrying means, each image forming means comprising a latent image forming means for forming a latent image on the image carrier and a developing means for developing the latent image formed on the image carrier, wherein the toner images of the respective image forming means are transferred and superposed on the image transfer carrying means one by one. In this apparatus, the image forming means and image transfer carrying means are positioned in such a positional relation that the image transfer carrying means is in contact with the image carriers in the wrapping state to form nips and the apparatus further comprises a tension adjusting means for adjusting the tension of the image transfer carrying means. Therefore, the contact pressure can be easily applied by control of the wrapping angle and tension of the image transfer carrying means without special means for applying a predetermined contact pressure between each image carrier and the image transfer carrying means.

The tension adjusting means is one of the rollers around which the image transfer carrying means is laid and which drive the image transfer carrying means, the one roller having a tension applying function. The image transfer carrying means is laid around two rollers at least one of which has a tension applying function. Since the contact pressure is controlled by the wrapping angle defined according to the positional relation or by the tension produced by the roller having the tension applying function, the contact pressures relative to the respective image carriers can be set to be substantially equal or the contact pressures can be individually set.

In the image transfer carrying means, transfer bias applying means composed of conductive rollers which rotate according to the movement of the image transfer carrying means, conductive electric members, or conductive brushes are disposed on the back of the image transfer carrying means at positions of contact portions with the image carriers. It is not required to apply pressing force to form transfer nips. Therefore, the sliding resistance between the transfer bias applying means and the image transfer carrying means should be small, thus not only increasing the lives of them but also reducing the manufacturing cost.

The image forming means and the image transfer carrying means are disposed such that the lower side surface of the image transfer carrying means is in contact with the image carriers, and the image transfer carrying means is an intermediate transfer medium or a sheet carrying medium which attracts and carries a sheet on its surface so that toner images are transferred and superposed on the sheet. Therefore, the toner images are superposed one by one to form an image without stain due to spillage of toner.

As mentioned above, the present invention can provide an image forming apparatus, capable of providing high-quality images, in which the transfer condition can be stabilized by a reasonable structure and the deterioration of image quality can be prevented.

What we claim is:

1. An image forming apparatus comprising:

an image transfer carrying means having flexibility and having an endless sleeve-like shape; and a plurality of image forming means which are arranged along an arcuate oblique line of the image transfer carrying means such that respective image carriers thereof are in contact with the image transfer carrying means, each image forming means comprising a latent image forming means for forming a latent image on the image carrier and a developing means for developing the latent image formed on the image carrier;

wherein a wrapping angle of the image transfer carrying means relative to the image carrier of each image forming means is defined by the curvature of the arcuate line, and a nip width and a contact pressure are defined by the wrapping angle and by the tension of the image transfer carrying means so that the developed toner images of the respective image forming means are transferred and superposed on the image transfer carrying means one by one;

wherein the image carriers of said image forming means and said image transfer carrying means are set to have velocity difference therebetween; and wherein the image transfer carrying means is laid around at least two rollers, and the position of the driving roller is selected to the upstream side or the downstream side according to the velocity difference relative to the image carriers.

* * * * *